United States Patent [19]

Müller et al.

[11] 4,385,541

[45] May 31, 1983

[54] OPERATING APPARATUS USED AT AN ELECTRONIC INSTRUMENT PROVIDED WITH AT LEAST ONE SYNTHESIZER

[75] Inventors: Walter Müller, Binningen; Urs P. Studer, Riehen; Harald Blobel, Bottmingen, all of Switzerland

[73] Assignee: Walter Müller, Binningen, Switzerland

[21] Appl. No.: 351,129

[22] Filed: Feb. 22, 1982

[30] Foreign Application Priority Data

Feb. 25, 1981 [CH] Switzerland ..... 1260/81

[51] Int. Cl.[3] ..... G10H 1/03; G10D 7/12

[52] U.S. Cl. ..... 84/1.14; 84/1.04; 84/377; 84/DIG. 14

[58] Field of Search ..... 84/1.04, 1.14, DIG. 14, 84/93, 377, 1.08

[56] References Cited

U.S. PATENT DOCUMENTS 2,945,408 7/1960 Terlinde ..... 84/1.04

3,322,875 5/1967 Roll et al. ..... 84/1.14

3,516,320 6/1970 Hillairet et al. ..... 84/1.14

*Primary Examiner*—J. V. Truhe

*Assistant Examiner*—Forester W. Isen

*Attorney, Agent, or Firm*—Werner W. Kleeman

[57] ABSTRACT

To simplify playing of an electronic instrument and to avoid the otherwise clearly recognizable synthetic sound quality, the operating elements are arranged in a wind or blowing body constructed and playable similar to a mouth-harmonica. These operating elements comprise a pressure sensor responsive to the blowing and suction air current or stream of a human being and which is coupled to a mouthpiece displaceable along the wind or blowing body, and a number of position sensors which respond in accordance with the momentary position of the mouthpiece. The pressure sensor and the position sensors are coupled to an evaluation circuit which is structured such that it generates, as a function of the response of these sensors, the control voltages required for controlling the synthesizer.

9 Claims, 4 Drawing Figures

OPERATING APPARATUS USED AT AN ELECTRONIC INSTRUMENT PROVIDED WITH AT LEAST ONE SYNTHESIZER

BACKGROUND OF THE INVENTION

The present invention relates to a new and improved construction of operating apparatus for an electronic musical instrument provided with at least one synthesizer.

Generally speaking, this operating apparatus comprises a wind or blowing body constructed and playable similar to a mouth-harmonica and in which there are arranged elements responsive to the blowing and suction air current or stream of a human operator and to the location where such occurs. These elements control the synthesizer as a function of their response.

An operating apparatus of this general type has become known to the art, for instance, from German Patent Publication No. 1,772,103 published Apr. 8, 1971, wherein there is described an electronic mouth-harmonica. As with a conventional mouth-harmonica, the wind or blowing body of this prior art operating apparatus is provided with a row of wind or blow-holes, from each of which there outbounds a flow channel. Operatively associated with each of these flow channels is an element which has a piston or bellows-like configuration and responds with a mechanical motion to negative pressure, i.e. suction, and excess pressure, i.e. blowing. Each of these elements cooperates with a resilient lamella or small plate such that upon response of the related element the lamella is lifted and together therewith there equally is lifted-off a contact rail which extends over all lamellae and in its rest position contacts all of the lamellae. With a lamella lifted, there thus exists an electrical contact only between this lifted lamella and the contact rail. Each lamella is electrically connected to the junction or node between two successively arranged resistors of a large number of resistors which are connected in series. These series-connected resistors form a circuit element which determines the frequency of an oscillator incorporated into the wind or blowing body itself. Depending upon which lamella is lifted by suction or blowing, there can be altered the resistance value of the series circuit, and thus, the frequency of the electrical oscillations generated by the oscillator.

Furthermore, this prior art operating apparatus also is provided with a light barrier containing a photoresistor forming a receiver. According to the amount by which the aforementioned contact rail is lifted, this light barrier is interrupted to a greater or lesser extent. By altering the resistance value of the photoresistor there is correspondingly altered the amplitude of the electrical oscillations generated by the oscillator. With this state-of-the-art apparatus, the thus generated electrical oscillations are further converted or transformed, for instance by superimposing thereon overtones or harmonics or by subjecting them to frequency division and amplification, and thereafter, these modified electrical oscillations are delivered to an electro-acoustic converter. This electro-acoustic converter transforms the received periodic electrical signal into an appropriate acoustical sound.

This prior art operating apparatus is afflicted with various and, in part, considerable disadvantages, of which only a few will be described hereinafter. Since each of the flow-channels outbounding from the wind or blow-holes is operatively associated with a mechanically movable element responding to excess pressure, i.e. blowing, or negative pressure, i.e. suction or sucking, it is practically impossible that all these elements react to the same degree to an excess pressure or negative pressure which is predetermined with respect to its value. As a consequence, the loudness level or intensity of the sound which is audible from the electro-acoustic converter can vary from blow-hole to blow-hole, even with a constant value of the excess pressure or negative pressure. Moreover, the mechanically movable elements, responsive to excess pressure and negative pressure, are fully exposed to the human suction or blowing air current or stream. However, especially the blowing air stream of a human is everything else but purely clean dry air. Therefore, the mobility of these elements is considerably impaired even after a short period of use of such prior art apparatus, which also affects the operation, especially that of the electrical part of the apparatus.

Furthermore, the resistance values of the resistors of the afore-mentioned series circuit are temperature-dependent, so that the frequency of the electrical oscillations generated by the oscillator, and together therewith the pitch of the sound generated by the converter, fluctuate, even if to a lesser extent, as a function of the ambient temperature and the temperature of the apparatus, respectively.

Since, with the known operating apparatus there are present a large number of movable elements which, at least theoretically, should react or move even under the influence of very small forces, i.e. slight blowing or suction pressure, the prior art apparatus, during playing, equally reacts in a very sensitive manner to shocks and/or vibrations which act upon the wind or blowing body. Therefore, the musician, during playing, has to be very conscious that he or she does not impart any sudden movements or accelerations to the wind or blowing body.

Other exemplary constructions of the prior art are typified by the disclosures of U.S. Pat. No. 3,143,027 and German Patent Publication No. 2,338,513.

SUMMARY OF THE INVENTION

Therefore, with the foregoing in mind it is a primary object of the present invention to provide a new and improved construction of operating apparatus of the initially mentioned type, which is not associated with the afore-mentioned drawbacks and limitations of the prior art constructions.

Another important object of the present invention is to provide a new and improved construction of operating apparatus of the initially mentioned type which, in comparison with prior art constructions, gives full interpretational freedom to the musician or player.

Yet another important object of the present invention is to provide a new and improved construction of operating apparatus of the initially mentioned type, which does not noticeably react to shocks or temperature fluctuations.

Finally, it is an important object of the present invention to provide a new and improved construction of operating apparatus of the initially mentioned type, which only requires a minimal amount of mechanically movable parts or elements.

Now in order to implement these and still further objects, which will become more readily apparent as the description proceeds, the operating apparatus according to the invention is manifested by the features that, there is arranged at the wind or blowing body a displaceable mouthpiece provided with a single blowing and suction opening. This blowing and suction opening, in turn, is coupled to a static pressure converter or transducer. Along the displacement path of the mouthpiece there is arranged a row of positioning sensors, each of which cooperates with a component or element which is displaceable together with the mouthpiece. Both the static pressure converter and the position sensors are coupled to an evaluation circuit which according to the response thereof generates control voltages for the synthesizer.

BRIEF DESCRIPTION OF THE DRAWINGS

The invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Figure 1:
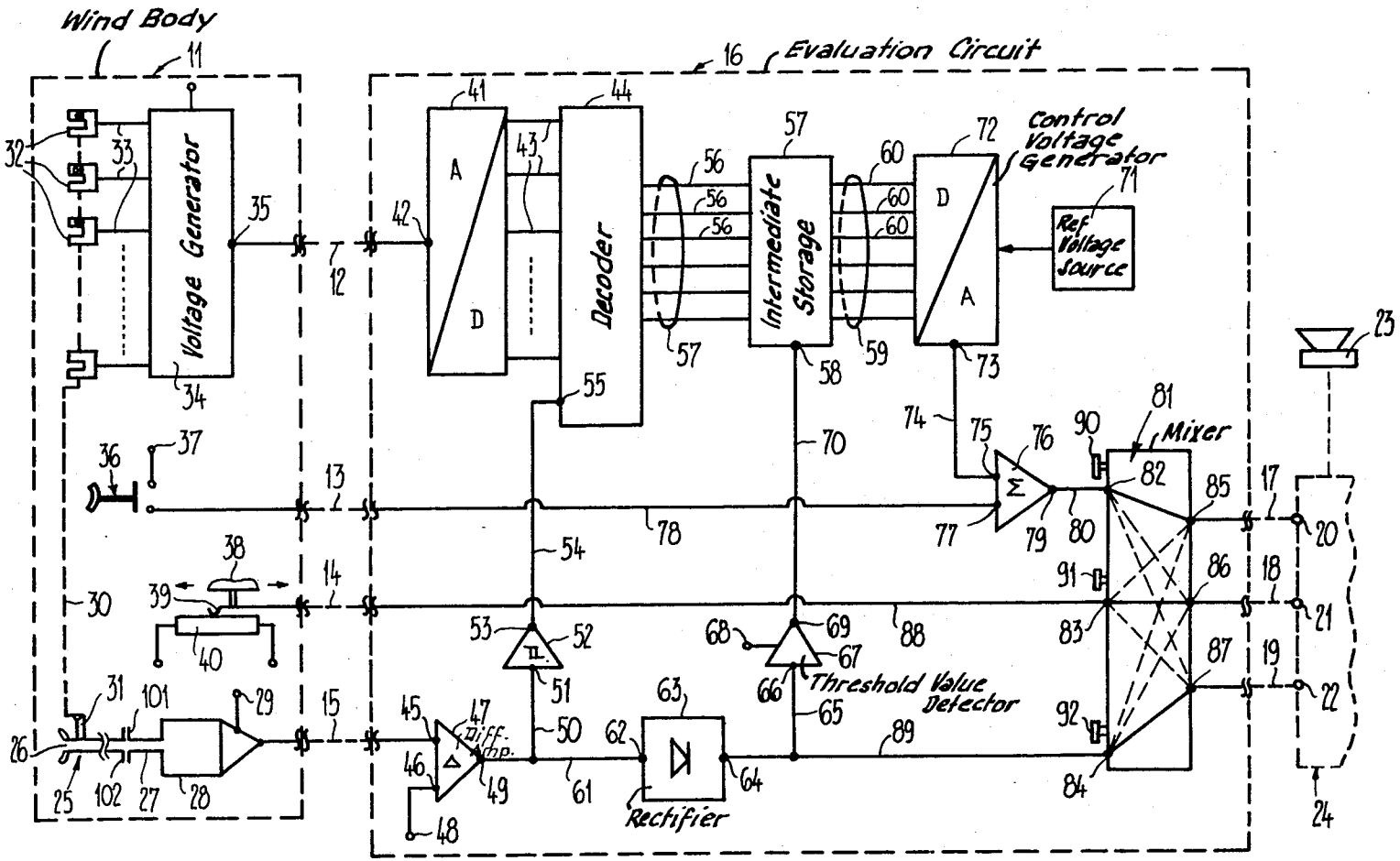
FIG. 1 is a simplified electrical block circuit diagram of an exemplary embodiment of operating apparatus according to the invention.

Describing now the drawings, it is to be understood that only enough of the construction of the equipment has been conveniently illustrated as needed to enable those skilled in the art to readily understand the underlying principles and concepts of the invention, while simplifying the illustration of the drawings. The apparatus, illustrated by way of example, in FIG. 1 comprises a wind or blowing body 11 which, as will be described more fully hereinafter, is constructed and playable similar to a mouth-harmonica. This wind or blowing body 11 is connected to an evaluation circuit 16 by means of the electrical lines 12, 13, 14 and 15. The output lines 17, 18, and 19 of this evaluation circuit 16 are connected to control voltage inputs 20, 21 and 22 of a synthesizer 24 which is merely schematically indicated in the drawing and provided with a loudspeaker system 23. It is assumed that the control voltage appearing at the input 20 is decisive for pitch, the control voltage appearing at the input 21 is decisive for timbre, and the control voltage appearing at the input 22 is decisive for the volume or intensity of the produced sound.

The wind or blowing body 11 is equipped with a mouthpiece 25 which is displaceably guided thereat and which is provied with a wind or blowing opening 26. This mouthpiece 25 is connected to a pressure measuring cell 28 by means of a flexible conduit or line 27. The pressure measuring cell 28, which is connected to a reference voltage source 29, for instance, of 2 volts and with its output to the line 15, is structured such that it delivers at its not particularly referenced output a voltage signal which, with an excess pressure prevailing in conduit 27, deviates to one side of the reference voltage and in the case of a negative pressure deviates to the other side of the reference voltage. The magnitude of this deviation corresponds to the magnitude of the excess pressure or negative pressure, respectively. When no air stream or current is present in the conduit or line 27 the output signal of the pressure measuring cell 28 corresponds to the reference voltage tapped-off at the reference voltage source 29. Further details concerning the mouthpiece 25 will be described hereinafter with respect to FIGS. 2 and 3.

As mentioned above, the mouthpiece 25 is displaceable along the wind or blowing body 11, which has been indicated in FIG. 1 by means of the broken line 30. The mouthpiece 25 is provided with a tab or lug 31 which, during the course of the displacement of such mouthpiece 25, engages with at least one, for instance, of 15 or 16 position sensors 32 which are arranged in a row along the mouthpiece displacement path 30. In the embodiment under discussion the position sensors 32 are constructed as so-called fork couplers, i.e. each position sensor 32 is a light barrier constituted by a light source, for instance a light-emitting diode (LED), and a light-sensitive element, for instance a phototransistor, and which light barrier can be interrupted by means of the tab or lug 31 or equivalent structure.

As position sensors 32 there equally can be provided proximity switches. In the present embodiment each position sensor 32 is coupled by means of its own separate line 33 to a staircase voltage generator 34. At its output 35, which is connected with the line 12, this staircase voltage generator 34 generates a voltage signal for each position sensor 32, provided that the same responds, and this voltage signal is characteristic for the related position sensor 32. In the staircase voltage generator 34 there can be integrated a selection or gate circuit, so that in the event of a coincidental simultaneous response of two adjacently arranged position sensors 32 there appears at the output 35 only one voltage signal which is characteristic for only one of the two position sensors 32.

Analogous to the wind or blow-channels of a mouth-harmonica, each position sensor 32 has correlated thereto two tones of an octave, as will be described in greater detail with respect to FIG. 4. Thus, at the output 35 there appears an analogue signal which is characteristic for the momentary position of the mouthpiece 25, and hence, for the pitch of the two tones which correspond to this position.

At the wind or blowing body 11 there is further provided a manually operable switch 36, by means of which an auxiliary voltage source 37 can be connected to the line 13. The auxiliary voltage generated by the auxiliary voltage source 37 serves for producing semitones, as will be more fully explained hereinafter.

Finally, there is also provided at the wind or blowing body 11 a manually operable slide or displacement member 38 which is connected to the tap 39 of a potentiometer 40 and serves for shifting this potentiometer tap 39 which is connected to the line 14. Consequently, there can be delivered to the line 14 a further voltage signal, and specifically this time a variable auxiliary voltage which results in a vibrator or glissando in the tones or sounds produced by the synthesizer.

In the evaluation circuit 16 there is provided an analogue-digital converter 41, the input 42 of which is connected to the line 12. The analogue-digital converter 41 possesses as many outputs 43 as there are provided position sensors 32 in the wind or blowing body 11, so that each output 43 is operatively associated with a position sensor 32. According to the level of the analogue signal appearing at the input 42 the analogue-digital converter 41 generates a digital signal at one of its outputs 43. These outputs 43 at the same time form the inputs of a decoder 44, the mode of operation of which will be explained more fully hereinafter.

The line 15, which is coupled with the pressure measuring cell 28 arranged in the wind or blowing body 11, is connected to one input 45 of a differential amplifier 47, the other input 46 of which is connected to a reference or set value-voltage source 48 which delivers, for instance, the same voltage as the reference voltage source 29. Thus, at the output 49 of the differential amplifier 47 there appears a differential signal, the polarity of which is dependent upon whether the pressure measuring cell 28 detects a negative pressure or an excess pressure. If the pressure measuring cell 28 detects neither a negative pressure nor an excess pressure, there appears no signal at the output 49, which is an indication that there is neither present a suction air stream nor a blowing air stream at the mouthpiece 25.

The output 49 of the differential amplifier 47 is connected by means of a line 50 to the input 51 of a comparator or a polarity detector 52, which delivers at its output 53 one of two digital signals as a function of the sign of the differential signal arriving from the output 49. The output 53 of the comparator or polarity detector 52 is connected by a line 54 to the last input 55 of the decoder 44.

The decoder 44 now assigns or correlates to each of its inputs 42 one of two numerical data as a function of the signal (suction or blowing) appearing at the input 55. This numerical data, for instance 1–32, i.e. according to the ordinal number of the full tones of four successive octaves, appears in binary-digital form at the output side 57 of the decoder 44. This decoder output side 57 contains six lines or conductors 56, corresponding to the powers $2^0$–$2^5$. Consequently, the position of the mouthpiece 25 at the blowing body 11 and the presence of a blowing or suction air current or stream, i.e. the "played" sound, are finally converted into unambiguous numerical data. This numerical data or information arrives via the lines 56 at an intermediate storage 57 provided with a control input 58. The intermediate storage 57 functions to a certain extent as a gate circuit or as a flip-flop in the sense that the numerical data appearing on the lines 56 is only transmitted unchanged to the output side 59 thereof, which equally comprises six lines or conductors 60, if there appears a control signal at the input 58.

The control signal at the input 58 is generated by the following elements: the output 49 of the differential amplifier 47, which carries a positive, a negative or no differential signal at all, is connected by means of a line or a conductor 61 to the input 62 of an active four-way rectifier 63. Hence, at the output 64 of the rectifier 63 there appears a unipolar analogue signal, the level of which is a function of the absolute value of the differential signal delivered by the output 49. The output 64 of the rectifier 63 is connected by a line or conductor 65 to the input side or input 66 of a threshold value detector 67 which is connected to a reference voltage source 68. This threshold value detector 67 only then delivers a digital signal at its output 69 when the signal arriving from the output 64 exceeds a predetermined level which is dependent upon the voltage or potential generated by the reference voltage source 68. In other words, there only then appears a signal at the output 69 when the pressure measuring cell 28 detects the static pressure of a stream or current which has a predetermined intensity in one or the other direction. The threshold value detector 67 thus prevents the accidental undesired air streams which have been generated, for instance, by an air draft and detected by the pressure measuring cell 28, in the mouthpiece 25, lead to the formation of signals which are further processed. The detector output 69 is connected by means of a line or conductor 70 to the control input 58 of the intermediate storage 57.

The output lines 60 of the intermediate storage 57 at the same time form the inputs of a control voltage generator 72 which is powered by a stabilized reference voltage source 71. This control voltage generator 72 functions in the manner of a digital-analogue converter and allocates to each numerical data delivered by the lines 60 a predetermined direct-current voltage, which appears at the output 73 of the control voltage generator 72. The difference between the two control voltages which are assigned to two successive numerical data is, for instance, constant. However, it must be considered that the voltages or potentials appearing at the output 73 must be tuned or correlated to the range of the control voltages required by the synthesizer 24 at the input terminal 20 thereof.

The output 73 of the control voltage generator 72 is connected by means of a line 74 to one input 75 of a summation or summing amplifier 76, the other input 77 of which is connected by means of a line or conductor 78 to the line 13, i.e. to the push-button switch 36 or the like. If the latter is pressed, the voltage delivered by the auxiliary voltage source 37 is transmitted to the summation amplifier 76 and added by the latter to the voltage delivered by the generator output 73. The amplitude of the voltage of the auxiliary voltage source 37 is chosen such that it results in half a tone step. The output 79 of the summation amplifier 76 is connected by a line or conductor 80 to a first input 82 of a mixer 81. The second input 83 of this mixer 81 is connected by a line or conductor 88 and the line 14 to the tap 39 of the potentiometer 40 and therefore receives the further, variable auxiliary voltage. The third input 84 of the mixer 81 is connected by a line or conductor 89 to the output 64 of the rectifier 63.

The mixer 81 possesses three outputs 85, 86 and 87 which are connected to the respective output lines 17, 18 and 19. According to the setting of the adjustment elements 90, 91 and 92 provided at the mixer 81 the outputs 85, 86 and 87 are coupled to various degrees to the inputs 82, 83 and 84. Thus, the output 85, for instance, essentially receives the voltage which appears at the input 82, which voltage, however, can be additionally influenced by the signals appearing at the inputs 83 and 84. The output 87 essentially receives the signal appearing at the input 84, which signal can be additionally influenced, however, by means of the signals appearing at the inputs 82 and 83.

By playing the wind or blowing body 11 in the fashion of a mouth-harmonica there are thus generated all control voltages necessary for controlling and operating the synthesizer 24.

Figure 2:
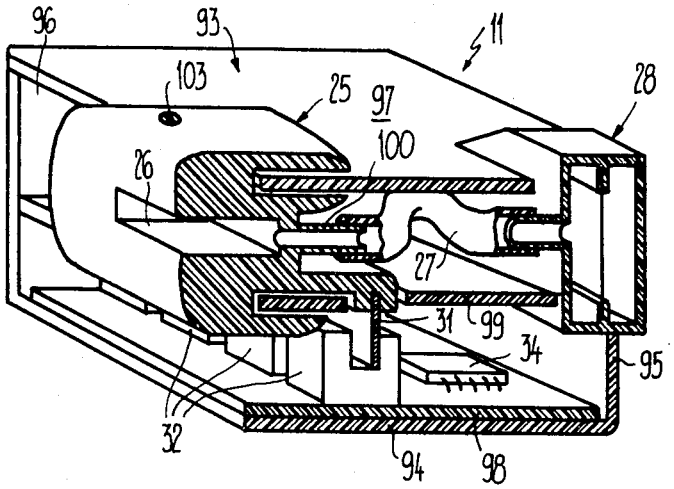
FIG. 2 is a simplified perspective and partially cut view of a wind or blowing body thereof.
Figure 3:
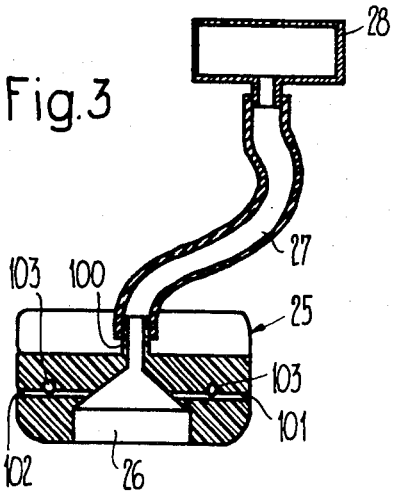
FIG. 3 is a simplified cross-sectional view of the mouthpiece provided at the wind or blowing body of FIG. 2, illustrating the connection of this mouthpiece to the static pressure converter.

In FIG. 2 there is illustrated in perspective cross-sectional view an embodiment of wind or blowing body 11 according to the invention. This wind or blowing body 11 is provided with an essentially box-shaped housing 93 which is essentially open towards one side and contains a floor or base 94, a rear wall 95, two lateral end walls 96 and an upper wall or plate 97. Secured to the floor or base 94 is a printed circuit board 98, upon which there are mounted the staircase voltage generator 34 which is fabricated as an integrated circuit, and the position sensors 32 which are mounted in a row. The mouthpiece 25, which is displaceable along the open side of the housing 93, is guided by the front edge of the upper plate or wall 97 and by a partition or separation wall 99, which is mounted between the upper wall or plate 97 and the floor or base 94. The pressure measuring cell 28 is fixedly mounted in the housing 93 and connected by the flexible hose conduit or line 27 to a connection or stud 100 which emanates from the blowing opening 26 provided in the mouthpiece 25. As can best be seen by referring to the showing of FIG. 3, there extend from the blowing opening 26 before the connection or stud 100 two, or equally only one, vent channel 101 and 102, of which the throughpass capacity or flow throughput can be altered, for instance by means of a throttle screw 103 or equivalent flow throttling element. If air is blown from the operator's mouth into the wind or blowing opening 26, or conversely, sucked-off out of the blowing opening 26, then the air stream or current exclusively flows through the throttled vent channels 101 and 102, and the pressure measuring cell 28 only registers the static pressure which is generated by blowing or sucking. Accordingly, this static pressure can be greater or smaller than the ambient pressure. In FIG. 2 there equally can be recognized the lug or tab 31 which is secured to the mouthpiece 25 and cooperates with the position sensors 32. For hygienic reasons the mouthpiece 25 preferably is mounted at the housing 93 so as to be exchangeable, and the hose conduit or line 27 can easily be detached from the connection or stud 100.

Figure 4:
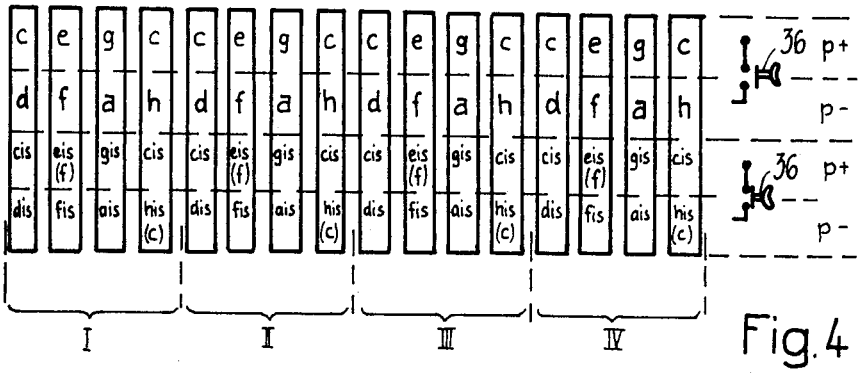
FIG. 4 illustrates a classification of the sounds which can be produced with an electronic musical instrument by means of the inventive operating apparatus according to the showing of FIG. 1.

FIG. 4 is a classification of the tones or sounds which can be produced with the synthesizer 24 by means of the embodiment of the invention according to FIG. 1. Each of the upright columns which are enclosed by a rectangle corresponds to one of the position sensors 32. Each column has four lines. In the upper two lines there are indicated the sounds or pitch which can be produced without operating the switch 36, and there are indicated in the line designated by reference character p+ at the right-hand side of the showing the sounds which are produced by blowing and in the line designated by reference character p− the sounds which are produced by sucking. In principle, the same holds true for the lower two lines wherein, however, there is now actuated the switch 36, i.e. there is connected the auxiliary voltage source 37 (FIG. 1).

It thus will be seen that with the described operating apparatus there can be "played", as with a larger mouth-harmonica, in four octaves which are designated by reference numerals I to IV. Furthermore, it is readily possible to play an electronic instrument by means of the described operating apparatus if a person is even half-way familiar with playing of a mouth-harmonica which, in turn, is easier to learn than a keyboard instrument. Finally, possibilities of personal interpretation are afforded to the degree that the musician is in command of his blowing and suction technique, which extensively avoids the synthetic "touch" and "quality" of electronically produced music.

There will be listed hereinafter, in exemplary manner, a number of commercially available circuit elements which can be used in the wind or blowing body 11 and in the evaluation circuit 16:

Pressure Measuring Cell 28: Pressure transducer or converter 140 PC, Type D, Manufacturer: Micro Switch Corporation Position Sensor 32: Contactless opto-electric switch, Type OPB 804, Manufacturer: Optron Incorporated Rectifier 63: Active precision absolute-value rectifier, as disclosed in publication of Jerald G. Graeme: "Application of Operational Amplifiers", McGraw-Hill Book Co., pages 120 and 121

Analogue-Digital Converter 41: IC-Driver, Type LM 3914, Manufacturer: National Semiconductor Company Decoder 44: Bipolar programmable logic circuit, Type 82 S 100, Manufacturer: Signetics Differential Amplifier 47 and Summation Amplifier 76: Operational amplifier, Type LM 324, Manufacturer: National Semiconductor Company Polarity Detector 52 and Threshold Detector 67: Voltage comparator, Type LM 3302, Manufacturer: National Semiconductor Company Control Voltage Generator 72: Digital-analogue converter, Type DAC 0808, Manufacturer: National Semiconductor Company While with the exemplary embodiment of the invention described herein the coupling or connection between the wind or blowing body 11 and the evaluation circuit 16 is galvanic, i.e. established by means of the lines 12 to 15, it is to be understood that such coupling equally can be established in wireless fashion, for instance by infrared radiation, ultrasonic waves or energy or even by radio communication, as is well known from remote control devices for television sets or the like. For this purpose, it only is necessary to augment both the wind or blowing body 11 and the evaluation circuit 16 with the appropriate signal converters and the transmitter receiver stages. It equally is possible to incorporate in the wind or blowing body 11 itself at least part of the evaluation circuit 16 in an integrated circuit mode or construction.

While there are shown and described present preferred embodiments of the invention, it is to be distinctly understood that the invention is not limited thereto, but may be otherwise variously embodied and practiced within the scope of the following claims. Accordingly,

What we claim is:

1. An operating apparatus for an electronic musical instrument provided with at least one synthesizer, comprising:

a wind body responsive means controlling the synthesizer as a function of their response;

a displaceable mouthpiece arranged at said wind body and movable along a predetermined displacement path;

said mouthpiece being provided with a single blowing and suction opening;

said responsive means comprising a static pressure converter;

said blowing and suction opening flow communicating with said static pressure converter;

whereby said pressure converter can detect an air current induced by a human blowing or sucking on said opening;

said responsive means further including position sensors arranged in a row along said displacement path of the mouthpiece;

a component displaceable together with said mouthpiece;

said position sensors cooperating with said component;

an evaluation circuit;

said static pressure converter and said position sensors being connected to said evaluation circuit; and said evaluation circuit generating control voltages for the synthesizer as a function of the response of said static pressure converter and said position sensors.

2. The operating apparatus as defined in claim 1, wherein:

said position sensors comprise light barriers;

said component comprising a tab;

said light barriers being interruptable by means of said tab; and said tab being mounted at said mouthpiece.

3. The operating apparatus as defined in claim 1, wherein:

said static pressure converter is stationarily arranged within said wind body; and a flexible conduit for connecting said static pressure converter to said blowing and suction opening provided at said mouthpiece.

4. The operating apparatus as defined in claim 1, further including:

at least one vent channel leading from said blowing and suction opening provided in said mouthpiece to the surrounding space; and said at least one vent channel having a limited flow throughput capacity.

5. The operating apparatus as defined in claim 4, further including:

means for adjusting said flow throughput capacity of said at least one vent channel.

6. The operating apparatus as defined in claim 1, further including:

a staircase voltage generator;

said position sensors being coupled to said staircase voltage generator;

said staircase voltage generator delivering a voltage characteristic for each position sensor in accordance with the response thereof.

7. The operating apparatus as defined in claim 1, wherein:

said mouthpiece is exchangeably arranged at said wind body.

8. The operating apparatus as defined in claim 6, wherein:

said evaluation circuit contains an analogue-digital converter;

said staircase voltage generator being coupled to said analogue-digital converter;

said analogue-digital converter possessing a number of outputs corresponding to the number of position sensors; and said analogue-digital converter being structured such that it generates a signal at one of its outputs as a function of a voltage generated by said staircase voltage generator.

9. The operating apparatus as defined in claim 8, wherein:

said evaluation circuit further includes a decoder and a differential amplifier;

the outputs of said analogue-digital converter being connected to said decoder; and said decoder being coupled to said static pressure converter by means of said differential amplifier.

* * * * *